United States Patent [19]

Pellaton

[11] 4,368,657

[45] Jan. 18, 1983

[54] FEEDER AND SLICER

[76] Inventor: Roy C. Pellaton, 2308 Virginia La., Stockton, Calif. 95204

[21] Appl. No.: 182,987

[22] Filed: Sep. 2, 1980

[51] Int. Cl.[3] ..... B26D 7/06

[52] U.S. Cl. ..... 83/356.3; 83/417; 83/409.2; 83/592; 241/92; 221/238

[58] Field of Search ..... 83/109, 155, 355, 356.2, 83/356.3, 409.2, 417, 431, 437, 591, 592, 732; 221/238; 241/92, 146, 151, 278 R

[56] References Cited

U.S. PATENT DOCUMENTS

| | | | |
|---|---|---|---|
| 553,385 | 1/1896 | Beamer | 83/356.3 |
| 2,169,323 | 8/1939 | Martinet | 83/591 X |
| 2,228,974 | 1/1941 | Portwood | 83/417 |
| 2,590,909 | 4/1952 | Westby et al. | 83/591 X |
| 3,972,256 | 8/1976 | Ross | 83/155 |
| 4,051,757 | 10/1977 | Reifenhäuser | 83/437 X |
| 4,198,887 | 4/1980 | Williams | 83/592 X |
| 4,244,252 | 1/1981 | Pellaton | 83/592 X |
| 4,277,995 | 7/1981 | Sontheimer | 83/355 X |

FOREIGN PATENT DOCUMENTS

| | | | |
|---|---|---|---|
| 1908738 | 9/1970 | Fed. Rep. of Germany | 83/431 |
| 555009 | 5/1977 | U.S.S.R. | 83/409.2 |

*Primary Examiner*—Stephen G. Kunin
*Assistant Examiner*—Robert P. Olszewski
*Attorney, Agent, or Firm*—Naylor, Neal & Uilkema

[57] ABSTRACT

Whole oriented items, such as onions, are sliced in a slicer by holding the items on a horizontal cutter-bearing plate and by rotating the plate to continuously remove slices from the lower ends of the items until they are fully sliced. The holding device include a box-like trap and cylinder-operated hold-down discs. The slicer knives are curved to effect a progressive, bias-type of cutting.

3 Claims, 4 Drawing Figures

2

FEEDER AND SLICER

RELATED APPLICATION

The present invention is an improvement upon the machine shown and described in co-pending application Ser. No. 28,105, filed Apr. 9, 1979, now Pat. No. 4,244,252, by me for Onion Conveyor and Slicer. The present improvement is upon the slicer and the feeder system, or supply and hold-down means for the slicer. Only the improved feeder and slicer means is shown in the subject application. Reference may be had to the forthcoming patent of said co-pending application for a disclosure of the rest of the machine.

BACKGROUND OF THE INVENTION

In the machine of the co-pending application, onions are positioned against a horizontal rotating plate while knife blades carried by the plate remove slices from the onions. Although the onions are laterally restrained by fence means and vertically restrained by hold-down means, it is possible for a slicing blade to flip or throw an onion out of slicing position. A number of factors contribute to such a possibility, e.g.: the resiliency of the onion, particularly when it is cut down to a thickness of an inch or less; the failure of the pocket provided by the fence and hold-down means to adequately restrain the onion during slicing; the tendency of the hold-down means to tilt the onion as it is pushed into the cutting pocket; and the high impact which results from the guillotine action of the straight blade.

SUMMARY OF THE INVENTION

The essential object of the present invention is to improve the machine of the co-pending application so that an item being sliced cannot be flipped out of its hold-down position by the action of the slicing blade.

This is accomplished by the provision of curved slicing blades, power cylinder actuated hold-down means, and a trap door feeder making it possible to employ a fully peripheral restraining fence means for the item being sliced.

Other objects and advantages of the invention will be apparent from the following description taken in conjunction with the drawings forming part of the specification.

DESCRIPTION OF THE PREFERRED EMBODIMENT

Figure 1:
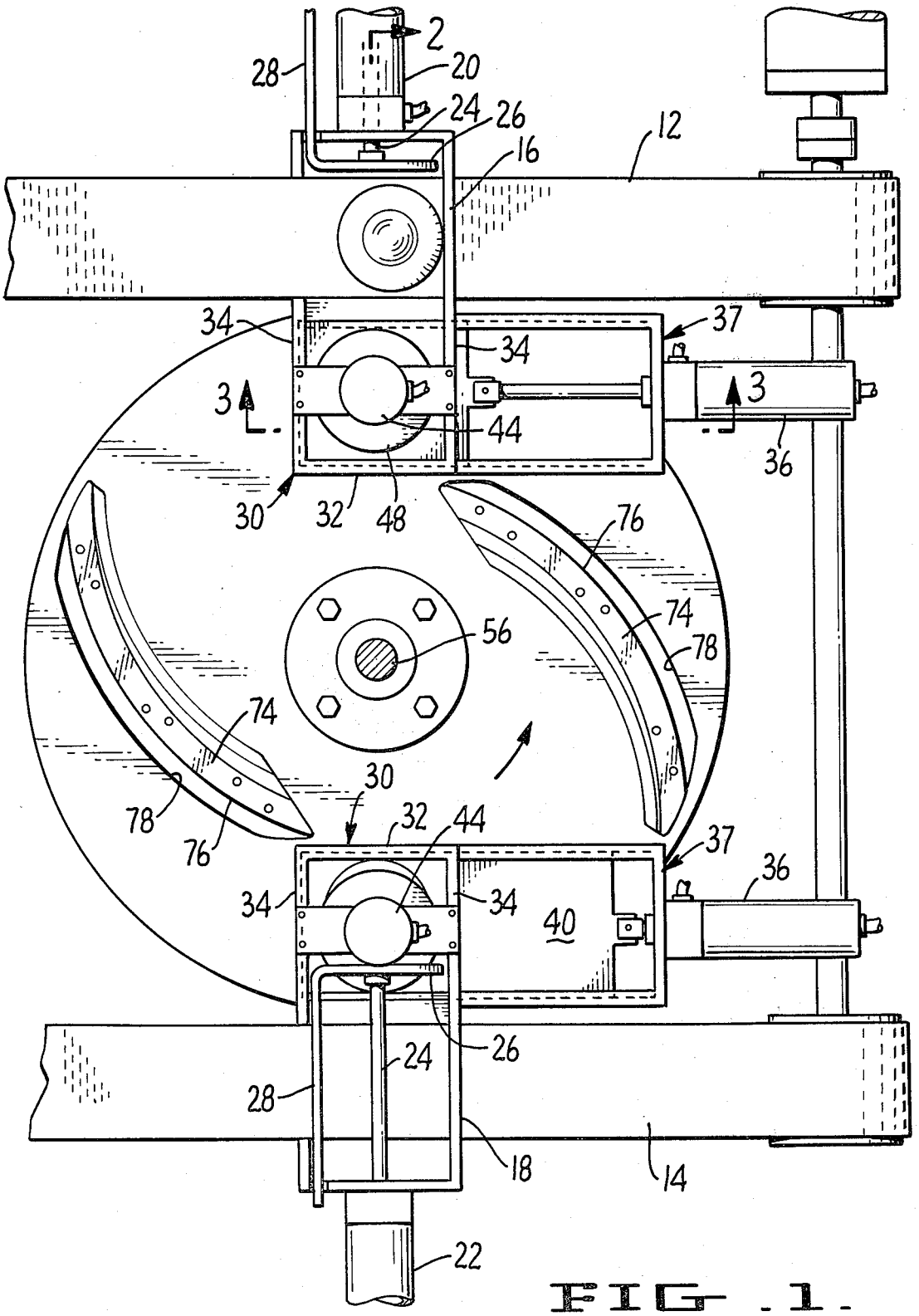
FIG. 1 is a top plan view of the improved feeder and slicer of the invention.
Figure 2:
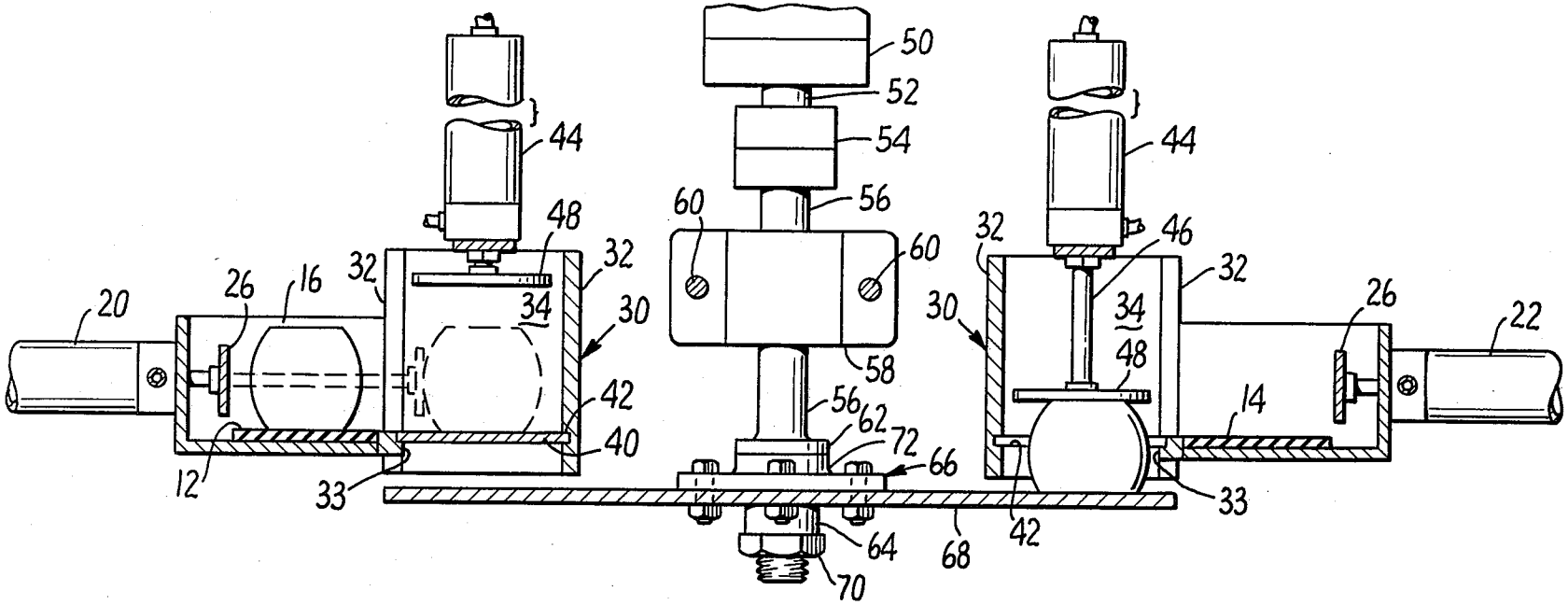
FIG. 2 is a view taken along lines 2—2 of FIG. 1.
Figure 4:
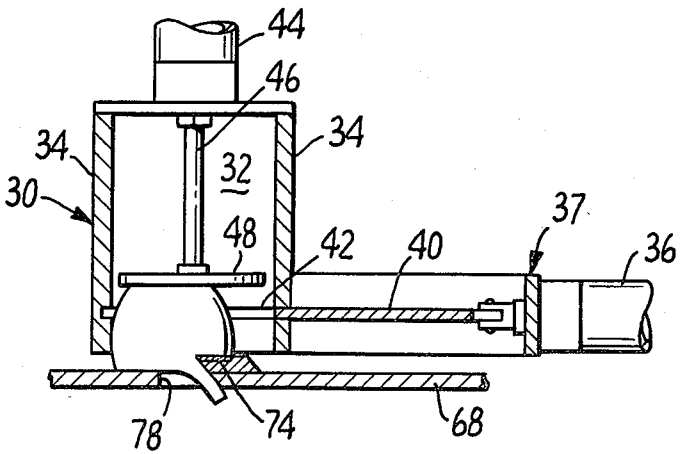
FIG. 4 is a view like that of FIG. 3 showing the trap door means in non-operating position and the hold-down means in operating position.
Figure 3:
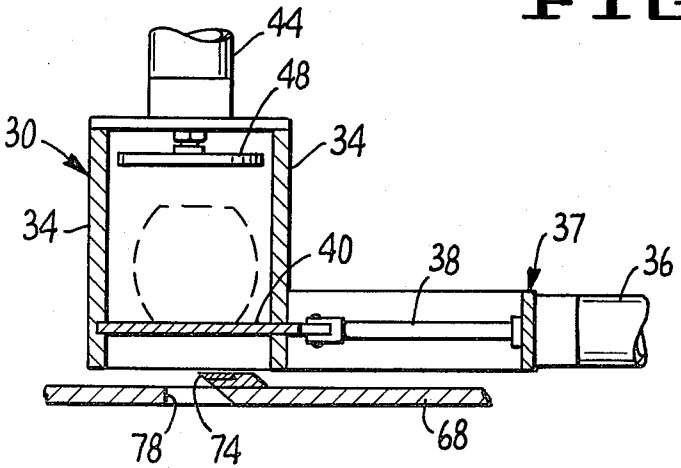
FIG. 3 is a view taken along lines 3—3 of FIG. 1 showing the trap door means in operating position and the hold-down means in non-operating position.

Although the following description will identify the item being sliced as an onion, it should be understood that the slicer may be used to slice other items, such as apples, pears, bell peppers, oranges, tomatoes, etc. The secure restraining and holding action and the gentle slicing action of the slicer facilitate it for use in cutting a wide variety of items.

The improved feeder comprises conveyors 12 and 14, sensor actuating stop members 16 and 18 extending across the conveyors, and power cylinders 20 and 22 having cylinder rods 24 provided with pusher plate elements 26 and trailing arm members 28.

The positioning and hold-down means of the improved machine comprise housings 30 formed of pairs of walls 32 and 34, power cylinders 36 supported by frames 37 attached to housings 30, cylinder rods 38 for cylinders 36 attached to trap doors 40 slidably disposed in grooves 42 in the housing walls, power cylinders 44 mounted on top of housings 30 and having cylinder rods 46 which carry onion hold-down discs 48.

The slicing means of the improved machine comprises drive motor 50, motor output shaft 52, shaft coupling 54, driven shaft 56, shaft bearing 58 carried by support means 60, a stop shim 62 fixedly attached to shaft 56, a sleeve 64 on the end of shaft 56 fixedly connected with flange 66, a plate 68 removably attached to flange 66, a nut 70 on the threaded end of shaft 56 to maintain the collar 72 of flange 66 against stop shim 62, curved knife blades 74 removably attached to plate 68 and provided with arcuate cutting edges 76, and onion slice passage slots 78 formed in plate 68.

The operation of the improved feeder and slicer is as follows. Onions which have been peeled and have had the root and crown surfaces well-defined by cutting are fed along the conveyors 12 and 14 until the leading onions engage stop members 16 and 18, whereupon sensing means, not shown, actuate cylinders 20 and 22 to cause pusher elements 26 to move the lead onions off of the conveyors and into the housings 30 where they are supported by trap doors 40. During such movement of the onions the hold-down discs 48 remain in an elevated condition out of engagement with the onions. While the onions are being so moved into place, the trailing arm elements 28 prevent the movement of the rest of the onions on the conveyors 12 and 14. After delivering of onions to the housings 30, the cylinders 20 and 22 are automatically actuated to fully retract cylinder rods 24. These rods remain retracted until other onions are in place along the conveyors opposite the housings and the housings are ready to receive other onions. The feeder cycle then repeats itself.

When the cylinder rods 24 of feeder cylinders 20 and 22 are retracted and when onions are in place on the trap doors 40, cylinders 36 and 44 are actuated to retract the trap doors and thereby drop the onions onto the plate 68 and to engage the tops of the onions with the hold-down discs 48. The withdrawal of the trap doors and the rotational movement of plate 68 causes the onions in the housings 30 to bear against a pair of corner walls where they are held by the discs 48 while the slices are removed by the knives 74. The rods 46 move downwardly as the onions are depleted by slicing and when the discs have reached low points indicating that the onions have been fully sliced the cylinders 36 and 44 are reversely operated to pull up the discs 48 and move the trap doors 40 back into the housings. The machine is then ready for the next cycle of operation.

It will be appreciated that the curved knives effect a progressive type of cut-slicing action rather than a chopping type of slicing action. There is a lesser degree of knife impact on the onions than there is in the machine of the co-pending application. There is therefore a lesser tendency on the part of the knives to tear the onions free from the overhead hold-down means. In any event, the knives are unable to flip the onions out of the housings 30 in the direction of the conveyors 12 and 14 because the onions reside within four-sided, or complete, wells once the trap doors have been retracted and the onions drop onto the plate 68. The walls 32 adjacent the conveyors are opened for the passage into the housings of the onions, but the barrier elements 33 at the conveyor sides of the housings serve to close the housings on their four sides against onion flip-out.

The hold-down discs 48 are preferably provided with irregular rubber surfaces to hold the onions against turning while they are being sliced.

What is claimed is:

1. In a slicer comprising: a horizontally disposed rotary plate; slicing knife means carried by said plate; pocket means to position an item on said plate for slicing, said pocket means having an open side for the passage of an item into said pocket means; a pusher to move an item through said open side; and a hold-down means to press said item against said plate as it is sliced by said knife means, the improvement therein comprising a slidable trap door disposed in parallel relationship to said plate and associated with said pocket means to support an item pushed into said means by the pusher in an upright condition spaced above said plate, said door being selectively retractable to permit an item supported thereon to lower onto said plate while remaining in an upright condition confined within said pocket means; and box-like pocket means adapted to fully laterally enclose and entrap said item while it is on said plate.

2. The combination of claim 1, said hold-down means comprising a reciprocably operable disc-like hold-down member, and drive means for said trap door and for said hold-down member operable to move said trap door to its open position to deposit said item on said plate and to move said hold-down member into engagement with said item to press it against said plate.

3. The combination of claim 1, wherein the improvement further comprises the provision of an arcuate cutting edge for said knife means so positioned that said edge, from its leading end to its trailing end, is located progressively further away from the center of rotation of said plate, the leading end of said cutting edge being disposed inwardly of said item on said plate and the trailing end of said cutting edge being disposed outwardly of said item of said plate.

* * * * *